US006991275B2

(12) United States Patent
Zollondz et al.

(10) Patent No.: US 6,991,275 B2
(45) Date of Patent: Jan. 31, 2006

(54) BOTTOM HOOK BLOCK SYSTEM

(75) Inventors: Rüdiger Zollondz, Hornbach (DE); Hans-Peter Franzen, Walshausen (DE)

(73) Assignee: Terex-Demag & Co. KG, Zweibruecken (DE)

( * ) Notice: Subject to any disclaimer, the term of this patent is extended or adjusted under 35 U.S.C. 154(b) by 0 days.

(21) Appl. No.: 10/469,082

(22) PCT Filed: Feb. 12, 2002

(86) PCT No.: PCT/DE02/00558

§ 371 (c)(1),
(2), (4) Date: Dec. 12, 2003

(87) PCT Pub. No.: WO02/068309

PCT Pub. Date: Sep. 6, 2002

(65) Prior Publication Data

US 2004/0084917 A1 May 6, 2004

(30) Foreign Application Priority Data

Feb. 26, 2001 (DE) ..... 101 10 302

(51) Int. Cl.
*B66C 1/00* (2006.01)

(52) U.S. Cl. ..... 294/82.15

(58) Field of Classification Search ..... 294/82.15, 294/82.11, 82.12, 86.41, 82.1, 87.1; 254/388, 254/389, 393, 394, 399
See application file for complete search history.

(56) References Cited

U.S. PATENT DOCUMENTS 3,179,376 A * 4/1965 Botten ..... 254/401
3,351,372 A * 11/1967 Marks et al. ..... 294/81.5
4,721,286 A * 1/1988 Hey et al. ..... 254/399
5,911,410 A * 6/1999 Wullimann ..... 254/334
6,651,961 B1 * 11/2003 Meyer ..... 254/337
2004/0183061 A1 * 9/2004 Winter et al. ..... 254/411

FOREIGN PATENT DOCUMENTS

JP 08143266 * 11/1994

* cited by examiner

*Primary Examiner*—Kathy Matecki
*Assistant Examiner*—Esther Okezie
(74) *Attorney, Agent, or Firm*—Cohen, Pontani, Lieberman & Pavane

(57) ABSTRACT

The invention relates to a bottom hook block system for a given maximum load, for providing differently portative bottom hook blocks for a crane, especially for a heavy lift crane. The bottom hook block system comprises four individual roller blocks (1*a–d*) with a plurality of pulley blocks, two load hooks (2*a, b*) and two intermediate links (3*a, b*) by means of which two individual roller blocks (1*a, b* or 1*c, d*) can be combined to a double roller block (4). An equalizing link unit (5) consists of two equalizing links (6, 7) that are interlinked via a joint support (8) with a vertical and at least one horizontal rotational axis. One of the equalizing links (6) is linked via a first horizontal hinge (10*a, b*) with the two intermediate links (3*a, b*). The other equalizing link (7) is linked via at least one bearing block (11*a, b*) with a second horizontal hinge (12*a, b*) with the two load hooks (2*a, b*). The load hooks (2*a, b*) can be swiveled about a vertical rotational axis in the respective bearing block (11*a, b*). A bearing connection (13) is provided in at least one of the intermediate links (3*a, b*), the connecting dimensions corresponding to the second horizontal hinge (12*a, b*).

11 Claims, 3 Drawing Sheets

BOTTOM HOOK BLOCK SYSTEM

PRIORITY CLAIM

This is a U.S. national stage of application No. PCT/DE02/00558, filed on 12 Feb. 2002. Priority is claimed on that application and on the following application(s): Country: Germany, Application No.: 101 10 302.6, Filed: 26 Feb. 2001.

BACKGROUND OF THE INVENTION

1. Field of the Invention

The invention pertains to a bottom block system for handling a given maximum load, especially to a system for forming bottom blocks with different load capacities for cranes, especially heavy-lift cranes.

2. Description of the Related Art

Heavy-lift cranes have load capacities of at least several hundred tons. The bottom blocks used here, which have one or more load hooks, are not only rather tall, but also very heavy. In the case of a 1,000-ton crane, the bottom block with its load hook can be, for example, 4–6 meters tall and reach a total weight of approximately 35 tons. The bottom block and the load hook must be designed to handle a certain maximum load. The investment cost especially for the load hook is considerable. In most cases, however, these heavy-lift cranes lift loads which are considerably less than the allowable maximum load. In these cases, the high load capacity of the bottom block is not needed. A heavy-lift crane is often used in place of a crane with a smaller load capacity when there is a need to hoist a load while the boom is being held at a comparatively low angle and the load moment is therefore very high. The high intrinsic weight of the bottom block set up for the maximum load is therefore highly disadvantageous in this case.

To limit this disadvantage, it is known in principle that a bottom block can be formed out of two sheave blocks, for example, each of which has several sheaves. The two blocks can be hinged to each other by a triangular leveling link. Because two sheave blocks are provided, it is possible to use two lifting cables, which can lift double the load or which can be used to achieve a faster lifting speed. The load hook is attached rotatably to the leveling link in such a way that it can swing around both a horizontal and a vertical axis. A bottom block of this type can also be split; that is, the leveling link can be connected to only one of the two sheave blocks. As a result, the bottom block will have only half of the original load capacity. The disadvantage here, however, is that the load hook is much heavier than necessary, because it is still designed for the maximum load. In addition, no optimized solution is provided for managing loads which are significantly less than half the maximum load.

SUMMARY OF THE INVENTION

The task of the present invention is to provide a bottom block system of the type indicated above which, with respect to the lifting of loads which are significantly below the given maximum load, can be adapted much more flexibly to the individual load requirement and which can ensure a much more favorable relationship between the weight of the bottom block and the load to be lifted in any individual case. The goal is also to minimize the amount of equipment and also the amount of conversion work required.

One of the essential ideas of the present invention is that two hooks are provided from the very beginning to accept the intended maximum load. The load capacity of each of these hooks is equal to at least half the maximum load. In addition, the bottom block system according to the invention is designed in modular fashion, so that, with the use of the existing components, at least three different configurations for widely varying load classes can be assembled. The swivel joints by which the essential components are connected to each other are carefully matched to each other so that one part can be connected alternatively to several different parts.

In detail, the invention provides a bottom block system which is designed for a given maximum load and which is suitable for forming bottom blocks with different load capacities, especially for use on heavy-lift cranes. To simplify the construction of the blocks for the different load classes, relatively large assemblies in the form of individual sheave blocks are provided instead of individual sheaves; each of these sheave blocks comprises several sheaves, preferably at least five sheaves. In addition, two load hooks are provided, each of which is able to accept at least half the maximum load, each preferably having a load capacity in the range of 50–70% of the maximum load. Other essential components include two intermediate links, by means of which two individual sheave blocks can be combined to form a double sheave block. In addition, a leveling link unit is provided, which consists of two leveling links and a joint block, which connects the two leveling links to each other. The joint block has a vertical axis of rotation, so that one leveling link can rotate relative to the other leveling link. The two leveling links are preferably designed as triangular links as known in and of themselves. Whereas one of the two leveling links can be connected by first horizontal swivel joints to the two intermediate links, the other leveling link can be connected to the two load hooks via bearing blocks, each of which carries a second horizontal swivel joint. Each of the load hooks can rotate in its bearing block around a vertical axis. For the sake of clarification, it should be pointed out that the terms "horizontal" and "vertical" refer to the working position of the bottom block. So that the essential components can be connected to each other in different ways, it is provided that the connecting dimensions of the first horizontal swivel joints correspond to the connecting dimensions of the second horizontal swivel joints, which makes it possible for the associated components to be assembled in several different ways. It is also provided that a bearing connection with the same connecting dimensions as those of the second horizontal swivel joint is provided in at least one of the intermediate links. Each of the intermediate links is preferably connected by a third horizontal swivel joint to its associated sheave block.

As a result of this design, it is easy to assemble a bottom block for a given maximum load, the four individual sheave blocks being combined into two double sheave blocks by the use of the intermediate links. These double sheave blocks are hinged to each other in turn by one of the leveling links so that they can accept the maximum load. The two load hooks are connected to the first leveling link by a second leveling link and the joint block. Thus a bottom block can be assembled which is capable of lifting a maximum load of 1,000 tons and which picks up the load by the use of two 600-ton hooks, connected in parallel. The investment cost for these two load hooks is less than that for one 1,000-ton hook. When, for example, five sheaves are present in each individual sheave block, a total of 20 sheaves are available for the load cables in the bottom block. A bottom block of this type with an overall height of 5.7 m will have a total weight of 34 tons. A bottom block of this type can be operated with, for example, two lifting cables, each reeved 17 times. When the load to be lifted is significantly smaller than the maximum possible load, e.g., when it is only about half of the maximum possible load, only a modest amount of work is sufficient to adapt the bottom block to this new lifting task. For this purpose, the two leveling links are detached from the double sheave blocks, and only one of the two load hooks, along with its bearing block, is inserted into the appropriate bearing connection in the intermediate link of one of the two individual sheave blocks. As a result, the weight of the bottom block is reduced by approximately half, which thus now weighs only 17 tons. When two lifting cables, each reeved 8 times, are used, it is possible in this way, for example, to lift a maximum weight of 500 tons. When a single lifting cable reeved 18 times is used, the maximum permissible load increases to, for example, 530 tons. When the loads to be lifted are even smaller, the single load hook can also be connected to a single sheave block. In this case, when only a single lifting cable reeved 11 times is used, a maximum load of, for example, 350 tons can be lifted. The total weight of this smallest bottom block is then approximately 14 tons, which means that yet another significant weight reduction has been achieved in comparison with the setup for intermediate loads.

It is recommended that the connections between the joint block and the leveling links be designed as horizontal swivel joints to ensure the greatest possible flexibility of the bottom block during operation. It is also advantageous for the dimensions of the bearing connection by which the intermediate link is attached to at least one of the individual sheave blocks to correspond to the connecting dimensions of the second horizontal swivel joints which support the bearing blocks for the load hooks. As a result, it is possible to connect just one of the load hooks by itself directly to one of the individual sheave blocks.

Each of the intermediate links is advisably connected by way of a third horizontal swivel joint to the individual sheave blocks. When these third horizontal swivel joints are designed so that they can be locked, a rigid connection can be achieved between the two individual blocks. Thus it is possible to operate a double sheave block formed in this way with a single lifting cable, because it behaves as a rigid unit. The locking of the third horizontal swivel joints can be accomplished, for example, by screw joints between the framework which supports the common axle for the individual sheave block and the intermediate link.

It is advantageous to provide at least one of the intermediate links, which already has a suitable bearing connection for receiving the second horizontal swivel joint belonging to the bearing block for the load hook, with an additional bearing connection, which should be located above the first bearing connection just mentioned. The dimensions of this additional bearing connection should be the same as those of the third horizontal swivel joint. As a result, a single load hook can also be connected indirectly via one of the intermediate links to a single individual sheave block.

For the sake of simplifying production and ensuring the exchangeability of parts, the individual sheave blocks and the intermediate links should be designed and built to be as similar as possible. The same is also true for the connecting dimensions of all the horizontal swivel joints. This means, therefore, that the first, second, and third horizontal swivel joints and the additional bearing connections should all have the same connecting dimensions, so that they can be attached to each other.

DETAILED DESCRIPTION OF THE PREFERRED EMBODIMENT

Figure 1:
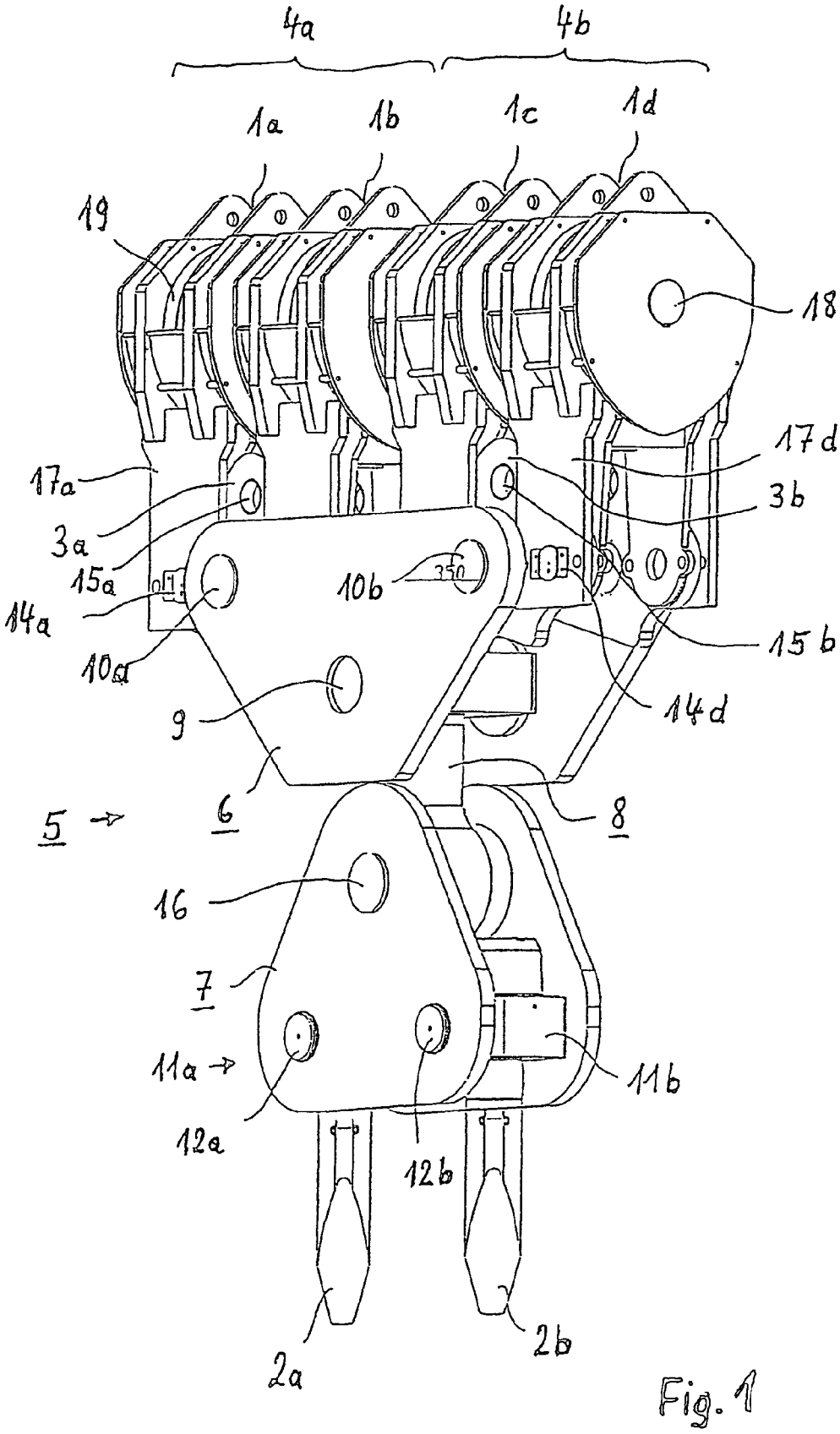
FIG. 1 shows a bottom block consisting of four individual sheave blocks assembled in accordance with the bottom block system of the invention.

FIG. 1 shows the maximum configuration of a bottom block assembled in accordance with the bottom block system of the invention. Four individual sheave blocks 1*a–d* are provided in all, which are assembled by way of two intermediate links 3*a, b* to form two double sheave blocks 4*a, b*. Each of the intermediate links 3*a, b* consists of a pair of a parallel support plates, as can be seen more clearly in FIG. 2. Each of the individual sheave blocks 1*a–d* is equipped with five sheaves 19, only one of which can be seen in each block in the diagram of FIG. 1. Each of the sheaves 19 of the individual sheave blocks 1*a–d* is supported on a common horizontal axle 18 in the framework 17*a–d* of the individual sheave block 1*a–d*. In view of the load being exerted on the axle 18, it is advantageous for three of the five sheaves 19 to be mounted in each case between the vertical retaining plates of the framework 17*a–d*, whereas the two remaining sheaves 19 rest against the outside surfaces of the retaining plates, one on the left, the other on the right. The intermediate links 3*a, b* are hinged to this framework 17*a–d* by bolt connections (third horizontal swivel joint 14*a–d*). By way of the two first horizontal swivel joints 10*a, b*, a leveling link unit 5 is hinged to these two intermediate links 3*a, b*. The leveling link unit 5 is formed by two leveling links 6, 7, each of which is designed as a triangular link. The two leveling links 6, 7 are connected to each other by a joint block 8, which has a swivel joint with a vertical axis of rotation. At its upper end, this joint block 8 is supported by bearing journals with a horizontal axis of rotation 9 in the upper leveling link 6, which, in the same way as the two intermediate links 3*a, b*, also consists of a pair of parallel support plates. A bearing (fourth horizontal swivel joint 16) is provided at the bottom end of the joint block 8; this bearing establishes the connection between the bearing block 8 and the lower leveling link 7, which is also formed by two parallel support plates. Underneath the fourth horizontal swivel joint 16, there are two additional swivel joints (second horizontal swivel joints 12*a, b*) in the lower leveling link 7 to accept the two bearing blocks 11*a, b*, each of which accepts a load hook 2*a, b* with a vertical axis of rotation.

Figure 2:
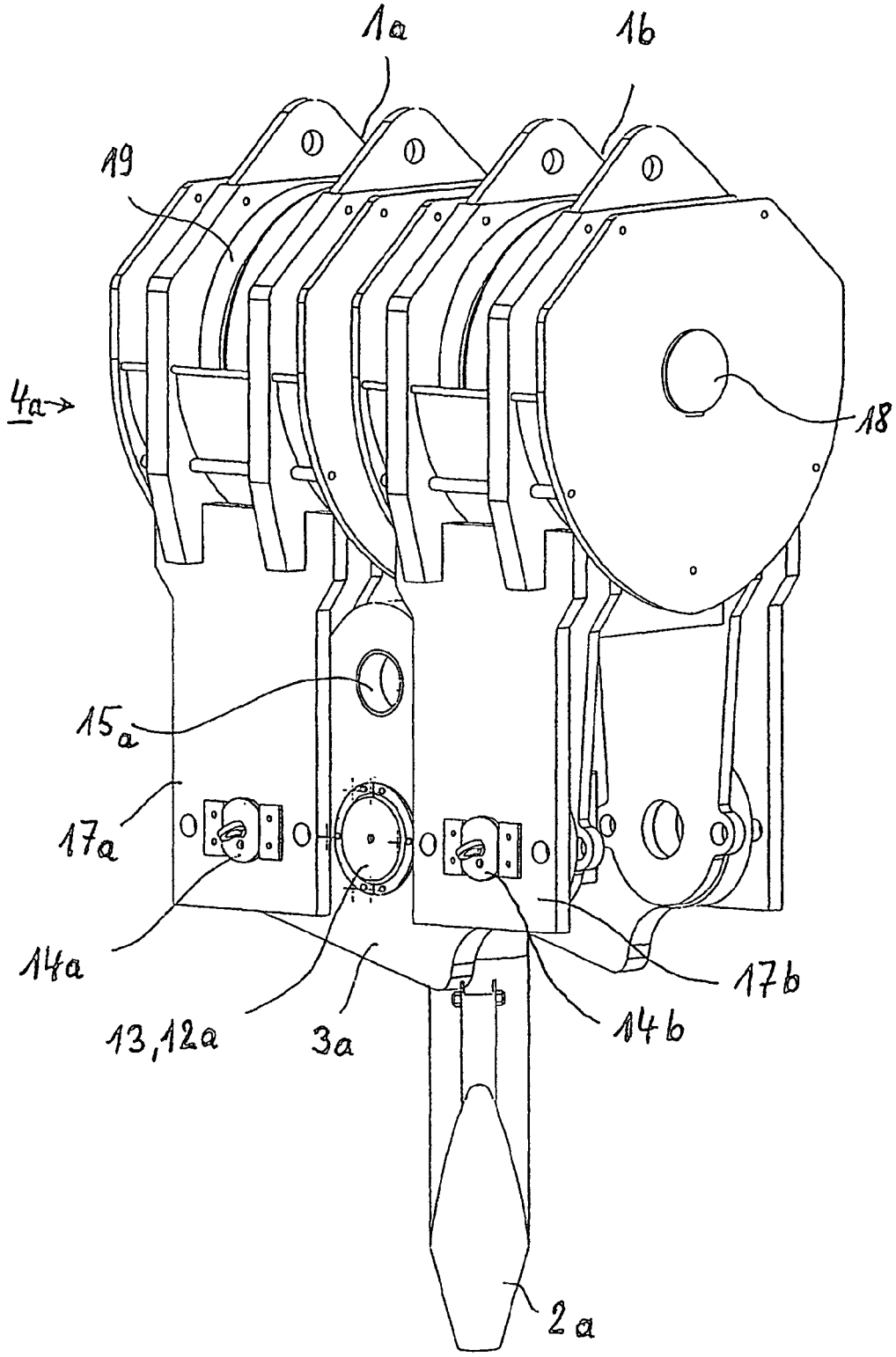
FIG. 2 shows a bottom block with two individual sheave blocks.

FIG. 2 shows a variant of the bottom block, which has been assembled from some of the components shown in FIG. 1, this version being suitable for a load equal to approximately half of the maximum possible lifting load. For this purpose, only one of the two double sheave blocks 4*a, b* in FIG. 1 is used. The leveling link unit 5 is removed. In place of the first horizontal swivel joint 10*a*, the second horizontal swivel joint 12*a* of the bearing block 11*a* is inserted here into the associated bearing connection 13 of the intermediate link 3*a*; the vertical swivel joint of this bearing block accepts the load hook 2*a*. To produce this variant, the only work required is to detach the bolt connection of the first horizontal swivel joint 10*a* and the bolt connection of the second horizontal swivel joint 12*a* so that the double sheave block 4*a* and the load hook 2*a* can be removed together with the associated bearing block 11*a*. These two assemblies are then connected to each other by the insertion of the second horizontal swivel joint 12*a* into the bearing connection 13 of the intermediate link 3*a* to obtain the finished bottom block with approximately half the maximum load capacity.

Figure 3:
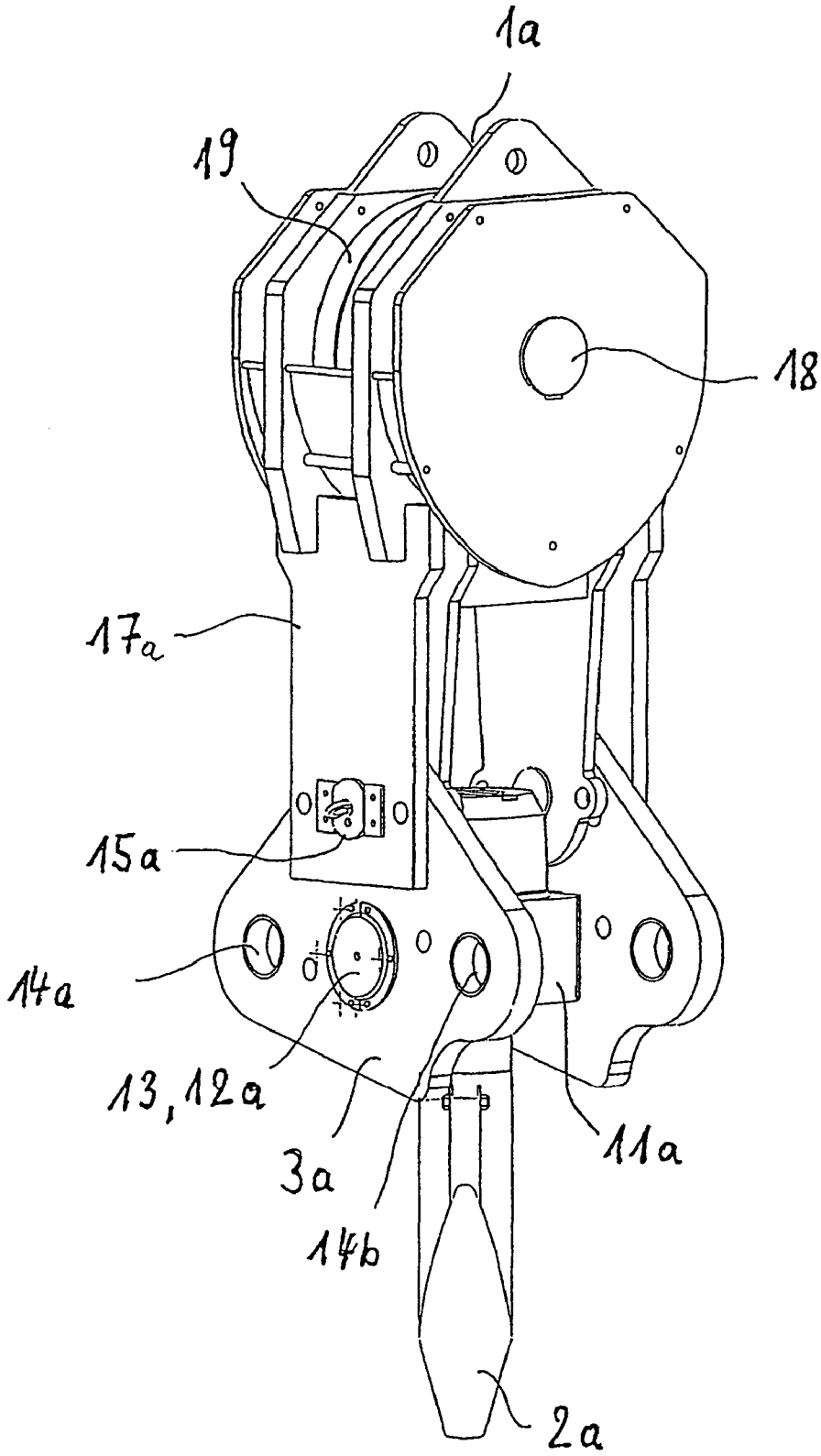
FIG. 3 shows a bottom block with one individual sheave block.

FIG. 2, like FIG. 1, shows that bearing connections 15*a, b* are provided in the intermediate links 3*a, b*, each one in the form of through-holes. These bearing connections 15*a, b* can, as is clear from FIG. 3, be used to connect a load hook 2*a* together with its bearing block 11*a*, via the intermediate link 3*a* alone, to a single individual sheave block 1*a* via appropriate bolt connections, that is, horizontal swivel joints. For this purpose, the bearing connections 15*a, b* have connecting dimensions which are the same as those of the third horizontal swivel joints 14*a–d*. The configuration according to FIG. 3 has a load capacity which is equal to approximately one-third of the permissible maximum load of the configuration according to FIG. 1.

Alternatively, the load hook 2*a* can be connected to an individual sheave block 1*a* without the intermediate presence of an intermediate link 3*a*. In this case, the second horizontal swivel joint 12*a* of a bearing block 11*a* of the associated load hook 2*a* will be introduced directly into the correspondingly dimensioned bearing connection [15*a*?—Tr. Ed.] provided for the third horizontal swivel joint in the framework 17*a*. This reduces not only the weight of the bottom block but also its overall height.

Of course, it is also possible to connect a load hook 2*a* to an individual sheave block 1*a* by way of the intermediate link 3*a* merely by detaching the third horizontal swivel joint 14*b* and removing the second individual sheave block 1*b*, which means that the third horizontal bearing 14*a* continues to function as usual. In this case, the intermediate link 3*a* would rotate 90° downward when load is applied.

The bottom block system according to the present invention makes available a low-cost modular system for the assembly of bottom blocks with a wide variety of permissible load capacities, where the intrinsic weight of these bottom hook blocks can be varied over a wide range to suit the permissible load capacity of the configuration in question. It is especially advantageous here that the concept of a single load hook designed to accept the entire maximum load of the bottom block system is abandoned. Instead of that, two load hooks are used, each of which can accept approximately half of the maximum load or slightly more. As a result, the cost of an extremely expensive, very large load hook can be avoided, and at the same time a single load hook can be made available which is already adapted to a load equal to less than the maximum. When the parts of the bottom block system which serve the same function are designed in the same way, it is even possible to assemble two independent bottom blocks at the same time, which can be used simultaneously for reduced load requirements. In principle, the bottom block system according to the invention can be used for any type of crane such as telescoping cranes, lattice mast cranes, harbor cranes, and even shipboard or floating cranes, which are designed in particular for high load capacities.

The invention claimed is:

1. A bottom block system for handling a given maximum load and for forming bottom blocks with different capacities for cranes, said system comprising:

four individual sheave blocks, each said sheave block comprising a plurality of sheaves;

two intermediate links, each said intermediate link being connectable to a pair of individual sheave blocks to form a double sheave block, at least one of said intermediate links having a first bearing connection with connecting dimensions;

a first leveling link connectable to respective said intermediate links by a pair of first horizontal swivel joints, each said first horizontal swivel joint having connecting dimensions which correspond to the connecting dimensions of said first bearing connection;

a second leveling link connectable to said first leveling link by a joint block having a vertical axis of rotation and at least one horizontal axis of rotation;

a pair of bearing blocks connectable to said second leveling link by a pair of second horizontal swivel joints, each said second horizontal swivel joint having connecting dimensions which correspond to the connecting dimensions of the first horizontal swivel joints; and a pair of load hooks connectable to said second leveling link by respective said bearing blocks, each said load hook being rotatable about a vertical axis of rotation in the respective bearing block, each said load hook being capable of handling at least half of the maximum load.

2. A bottom block system for handling a given maximum load and for forming bottom blocks with different capacities for cranes, said system comprising:

four individual sheave blocks, each said sheave block comprising a plurality of sheaves;

two intermediate links, each said intermediate link being connectable to a pair of individual sheave blocks to form a double sheave block, at least one of said intermediate links having a first bearing connection with connecting dimensions;

a first leveling link connectable to respective said intermediate links by a pair of first horizontal swivel joints, each said first horizontal swivel joint having connecting dimensions which correspond to the connecting dimensions of said first bearing connection;

a second leveling link connectable to said first leveling link by a joint block having a vertical axis of rotation and at least one horizontal axis of rotation;

a pair of bearing blocks connectable to said second leveling link by a pair of second horizontal swivel joints, each said second horizontal swivel joint having connecting dimensions which correspond to the connecting dimensions of the first horizontal swivel joints; and a pair of load hooks connectable to said second leveling link by respective said bearing blocks, each said load hook being rotatable about a vertical axis of rotation in the respective bearing block, each said load hook being capable of handling at least half of the maximum load, wherein each of said intermediate links is connectable to a respective said individual sheave block by a third horizontal swivel joint having connecting dimensions.

3. A bottom block system as in claim 2, wherein said at least one of said intermediate links has a second bearing connection with connecting dimensions corresponding to the connecting dimensions of the third horizontal swivel joint.

4. A bottom block system as in claim 3, wherein said second bearing connection has connecting dimensions corresponding to the connecting dimensions of the second horizontal swivel joint.

5. A bottom block system as in claim 1, wherein said joint block is connectable to said second leveling link by a fourth horizontal swivel joint.

6. A bottom block system as in claim 1, wherein each said load hook has a load capacity of 50–75% of the maximum load.

7. A bottom block system as in claim 2, wherein each of the third horizontal swivel joints can be locked to rigidly connect the respective said intermediate link to a pair of individual sheave blocks.

8. A bottom block system as in claim 1, wherein each said individual sheave block comprises five sheaves.

9. A bottom block system as in claim 1, wherein said sheave blocks are substantially identical.

10. A bottom block system as in claim 1, wherein said intermediate links are substantially identical.

11. A bottom block system as in claim 1, wherein at least one of said individual sheave blocks has a bearing connection with connecting dimensions corresponding to the connecting dimensions of said second horizontal swivel joint.

* * * * *

UNITED STATES PATENT AND TRADEMARK OFFICE

CERTIFICATE OF CORRECTION

PATENT NO. : 6,991,275 B2
APPLICATION NO. : 10/469082
DATED : January 31, 2006
INVENTOR(S) : Rüdiger Zollondz et al.

It is certified that error appears in the above-identified patent and that said Letters Patent is hereby corrected as shown below:

On the Title page with the following should read:

item --(73) Assignee Terex-Demag GmbH & Co. KG
Zweibruecken (DE)--

Signed and Sealed this

First Day of May, 2007

JON W. DUDAS
*Director of the United States Patent and Trademark Office*